United States Patent [19]

Thompson

[11] Patent Number: 4,457,513

[45] Date of Patent: Jul. 3, 1984

[54] REBOUND BALL GAME AND APPARATUS THEREFOR

[76] Inventor: Richard B. Thompson, 264 Beverly Hills Rd., Fort Lee, N.J. 07024

[21] Appl. No.: 474,167

[22] Filed: Mar. 10, 1983

[51] Int. Cl.[3] ..... G09B 71/02

[52] U.S. Cl. ..... 273/411; 273/342

[58] Field of Search ..... 273/411, 342

[56] References Cited

U.S. PATENT DOCUMENTS 3,671,040 6/1972 Meyer et al. ..... 273/342 X

*Primary Examiner*—William H. Grieb

*Attorney, Agent, or Firm*—Samuelson & Jacob

[57] ABSTRACT

A rebound ball game in which a ball is returned between opposed players within a prescribed court divided by a rebound apparatus having rebound faces and a specified return area, the rebound faces being angled for rebound of the ball toward the respective players, and the return area being located above the rebound faces for defining the appropriate area through which the ball is to be passed between the opposed players, the court having limited trapezoidal playing areas at each side of the rebound apparatus.

18 Claims, 4 Drawing Figures

REBOUND BALL GAME AND APPARATUS THEREFOR

The present invention relates generally to recreational activities and pertains, more specifically, to a novel rebound ball game and apparatus for playing the game.

Ball games played in courts have been perennial favorites among men, women and children and have evolved in a variety of different forms. In some of these games, such as tennis and paddle ball, the ball is returned directly over a net and the courts are relatively large. In other games, such as handball and racquet ball, the ball is subjected to rebounds and the courts are made relatively smaller.

It is an object of the game of the present invention to provide a ball game which combines rebound and return of the ball between opposed players on a relatively small court.

Another object of the invention is to provide a rebound ball game which can be played by men, women and children at many levels of skill for both exercise and pleasure.

Still another object of the invention is to provide a rebound ball game which requires only simple apparatus and minimal space for effective use.

Yet another object of the invention is to provide a rebound ball game which requires accuracy and coordination, yet is relatively simple to play and easy to learn.

A further object of the invention is to provide a rebound ball game which requires only inexpensive apparatus for playing and which can be played indoors or outdoors on a variety of playing surfaces which require no special preparation or finish.

A still further object of the invention is to provide a rebound ball game which can be played with two or four players within a minimal playing area.

Yet a further object of the invention is to provide a rebound ball game which is relatively safe for players of all ages, yet provides a high degree of player interest and satisfaction.

The above objects, as well as still further objects and advantages, are attained by the present invention which may be described briefly as a rebound ball game in which opposed players return a ball within a prescribed court extending along a horizontal playing surface in opposite longitudinal directions from a rebound apparatus located on the playing surface between the players such that the court is divided into first and second opposed playing areas with the rebound apparatus placed therebetween, the rebound apparatus comprising: first rebound means for placement laterally across the court to extend upwardly therefrom at an angle to the playing surface, the first rebound means including a first rebound face for confronting the first playing area and making an angle therewith such that upon reception of the ball from the first playing area the first rebound means will rebound the ball toward the first playing area; second rebound means for placement laterally across the court to extend upwardly therefrom at an angle to the playing surface, the second rebound means including a second rebound face for confronting the second playing area and making an angle therewith such that upon reception of the ball from the second playing area the second rebound means will rebound the ball toward the second playing area; and return area means between the first and second rebound means for defining an open, generally vertical return area of prescribed dimensions through which the ball is to be passed upon return of the ball from one of the first and second playing areas to the other of the first and second playing areas.

The invention will be more fully understood, while still further objects and advantages will become apparent, in the following detailed description of a preferred embodiment thereof illustrated in the accompanying drawing, in which.

Figure 1:
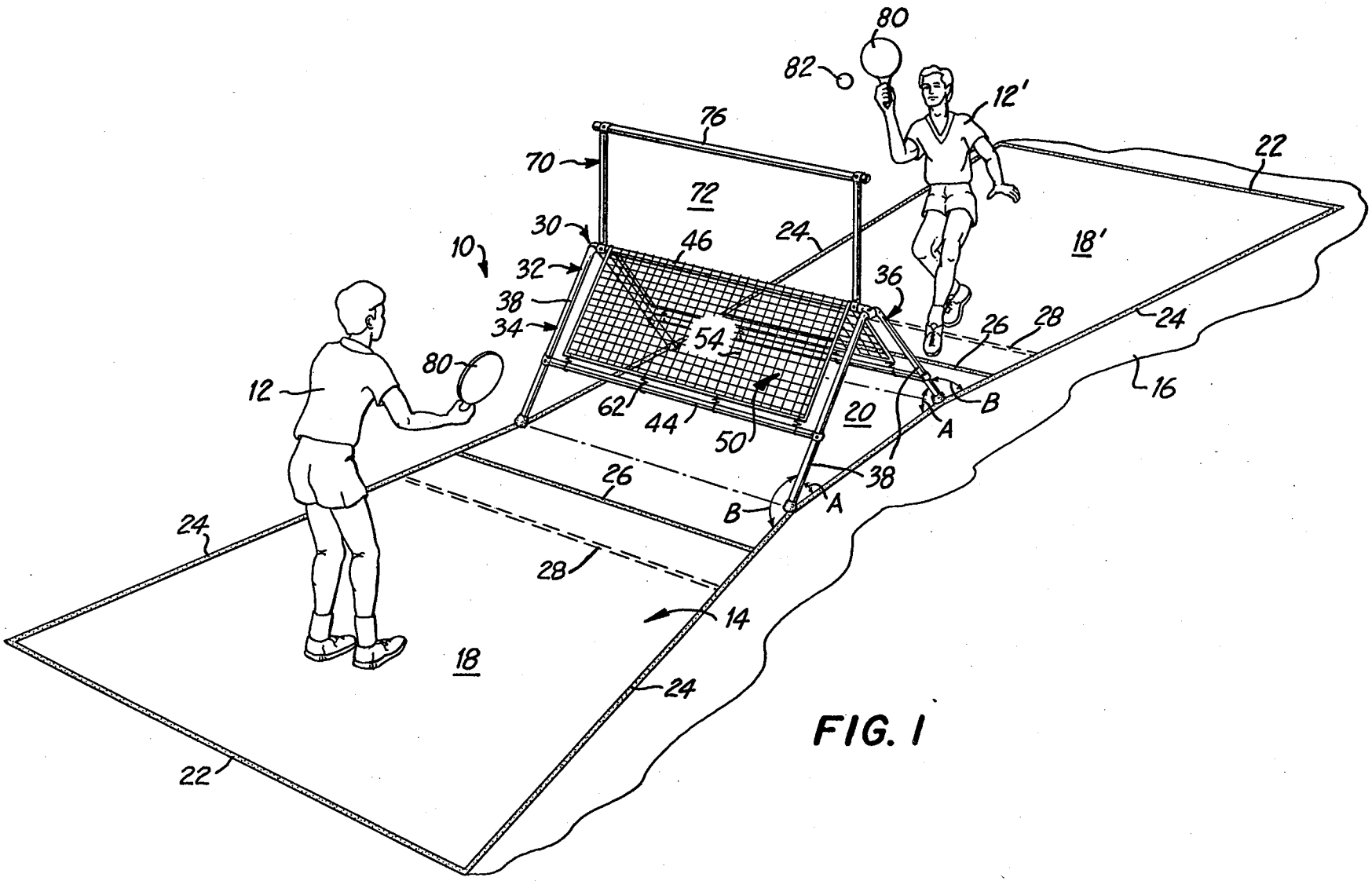
FIG. 1 is a pictorial perspective view illustrating a game of the invention as it is being played by two opposed players.

Referring now to the drawing, and especially to FIG. 1 thereof, a game of the invention is illustrated generally at 10 and is shown being played between two opposed players 12, 12' on a court 14 of prescribed configuration and dimensions. Court 14 extends along a horizontal playing surface 16 and includes first and second opposed playing areas 18, 18' extending in opposite longitudinal directions from a central court area 20 lying between the playing areas 18, 18'. Each playing area 18, 18' has a base line 22 and opposite side lines 24 extending from the central court area 20 to the corresponding base line 22. An "out-of-bounds" line 26 is placed in each playing area 18, 18' adjacent the central court area 20, and spaced therefrom, and a service line 28 extends laterally across each playing area 18, 18' at a location spaced back slightly from the corresponding out-of-bounds line 26.

A rebound apparatus 30 is placed upon playing surface 16 at the central court area 20, between the playing areas 18, 18' of court 14, and stands as a divider between the first and second playing areas 18, 18'. Rebound apparatus 30 includes a frame 32, preferably constructed of a metal or plastic tubing, carrying rebound means and return area means as will be described in greater detail below.

Figure 2:
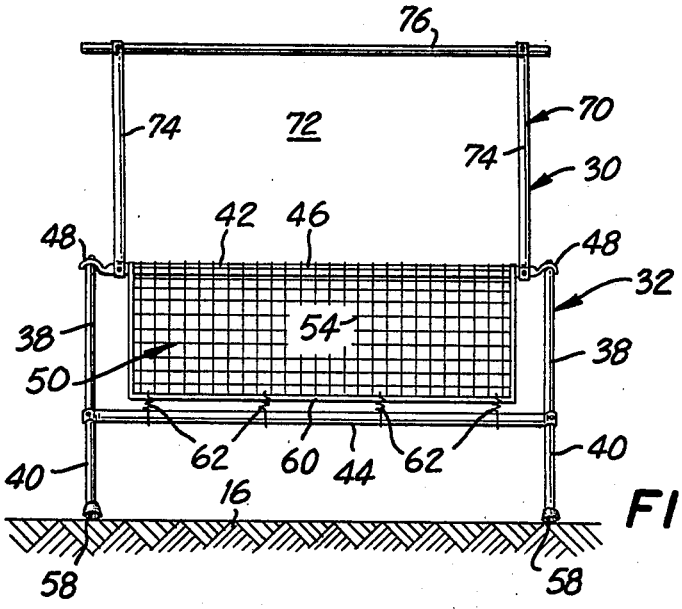
FIG. 2 is a front elevational view of the game apparatus used in playing the game.
Figure 3:
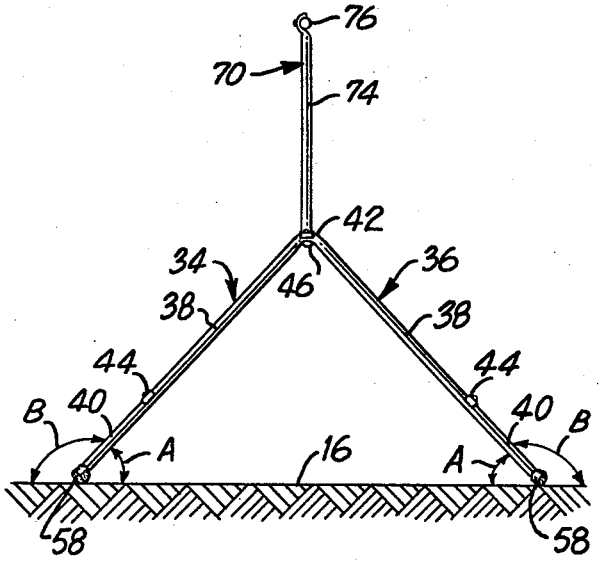
FIG. 3 is a side elevational view of the game apparatus.
Figure 4:
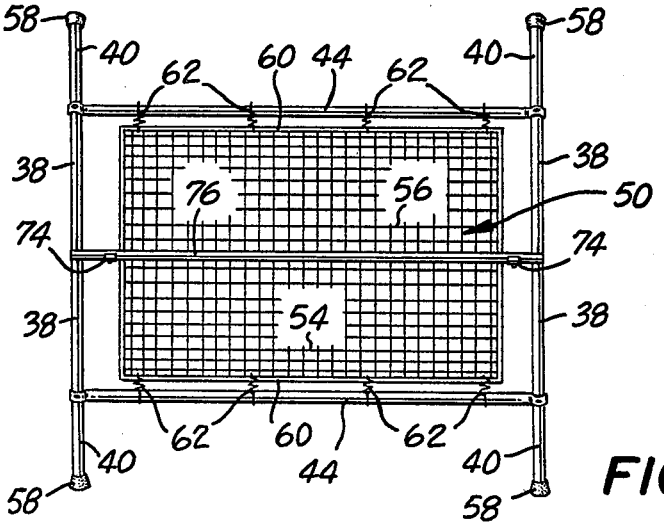
FIG. 4 is a top plan view of the game apparatus.

Turning now to FIGS. 2 through 4, as well as to FIG. 1, the frame 32 of apparatus 30 includes a first frame section 34, confronting the first playing area 18, and a second frame section 36, confronting the second playing area 18'. Each frame section 34, 36 has a pair of leg members 38 extending upwardly, generally parallel to one another within each frame section, from foot portions 40 to an apex 42 where the first and second frame sections 34 and 36 intersect. A lower cross-member 44 extends laterally between the parallel leg members 38 of each frame section 34, 36, between the corresponding foot portions 40 and the apex 42, and a common cross-member 46 extends laterally, between opposite ends 48, across the frame 32 along apex 42.

The frame sections 34 and 36 carry rebound means shown in the form of a rebound net 50 providing a first rebound face 54 on the first frame section 34 and a second rebound face 56 on the second frame section 36. Foot portions 40 preferably include feet 58 which rest upon the playing surface 16 and define a basal plane coextensive with the central court area 20. The frame sections 34 and 36 extend upwardly from the playing surface 16 at an acute angle A so that the rebound faces 54 and 56 each confront the corresponding playing areas 18 and 18' at an obtuse angle B. Thus, the frame sections 34, 36 and the central court area 20 of playing surface 16 form a triangular profile, as best seen in FIG. 3, with the leg members 38 extending along equal sides of the profile and the central court area 20 extending along the base so that the triangular profile is that of an isosceles triangle. The rebound net 50 preferably is in the form of a single panel having opposite ends 60, each end 60 being secured to a corresponding lower cross-member 44 by means of resiliently extensible tensioning members shown in the form of springs 62, the net 50 being passed over the common cross-member 46 and tensioned appropriately by springs 62 for performing the desired rebound function. Other rebound means, such as members in the form of solid panels of fabric, wood or other materials are possible, but a tensioned net is preferred for providing rebound faces 54 and 56.

Frame 32 of apparatus 30 has a third frame section 70 extending vertically upwardly from the apex 42 at the intersection of the first and second frame sections 34 and 36 and establishing the perimeter of an open return area 72 located immediately above the rebound faces 54 and 56. Third frame section 70 includes upright members 74 extending vertically upwardly adjacent the ends 48 of the common cross-member 46 and an upper cross-member 76 extending laterally across the frame 32 such that the upright members 74 and the cross-member 76 establish the open return area 72 immediately above the rebound faces 54 and 56. Preferably, all of the members of the frame 32 are assembled into an integral frame 32; however, some members may be constructed unitary with other members for ease of manufacture and use of the apparatus.

Returning now to FIG. 1, game 10 is shown being played by two opposed players 12, 12' each of which players is placed in a corresponding playing area 18, 18'. Each player 12, 12' carries a paddle 80 for striking a ball 82. One player 12, designated as the "server", stands behind the service line 28 and serves by hitting the ball 82 with paddle 80 into the corresponding rebound face 54. The obtuse angle B between the rebound net 50 and the playing area 18 assures that the ball 82 will rebound generally toward the server's playing area 18 so that the ball must be struck a second time by the server to pass the ball through the designated return area 72 to the second player's playing area 18'. The second player 12' must then strike the ball 82 with paddle 80 to hit the ball into rebound face 56 and, upon rebound, the ball must be hit again by player 12' to return the ball through return area 72 to the first player's playing area 18. Play continues with each player striking the ball twice for each play until one player fails to return the ball through the return area 72, or makes an error. Each player must first hit the ball into the corresponding rebound face 54, 56 and then return the ball through the designated rebound area 72, all while remaining within the boundaries of the base lines 22, side lines 24 and out-of-bounds lines 26. Thus, the game requires a quick response as well as accuracy to enable the ball to be rebounded and then directed through the limited target presented by return area 72. Game 10 may be played with four players (doubles) by placing two players in each playing area. In playing doubles, each player on a team will hit the ball once, with one player hitting the ball into the rebound face and the other hitting the ball through the return area.

Game 10 is played in a relatively small court which increases the necessity of quick response and accuracy. Dimensions for a typical court 14 include twelve-foot base lines 22 and ten-foot side lines 24. The central court area 20 is a rectangle extending six feet across the court and three feet along the length of the court. Each playing area 18, 18' thus is in the form of a trapezoid having the larger base at base line 22. The feet 58 of frame 32 are placed in each corner of the rectangular central court area 20 so that the base of the triangular profile of frame 32 is three feet and the lateral length of frame 32 is six feet, while each out-of-bounds line 26 is spaced one foot from a corresponding side of the central court area 20, and each service line 28 is spaced one foot from a corresponding out-of-bounds line 26. The height of the common cross-member 46 from the playing surface 16 is three feet and the distance between the common cross-member 46 and upper cross-member 76 also is three feet so that the target area presented by return area 72 is a rectangle three feet high and six feet wide; however, the dimensions of the target area may be made selectively variable in order to adjust the skill level of the game. Likewise, the dimensions and configuration of the court may be varied to adjust for various levels of skill. Thus, it will be seen that game 10 requires only minimal space for play. In addition, since the ball 82 is not required to rebound from the playing surface 16 when in play, the surface of the court 14 requires no special preparation or finish and game 10 may be played indoors or outdoors on a wide variety of playing surfaces.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a rebound ball game in which opposed players return a ball within a prescribed court extending along a horizontal playing surface in opposite longitudinal directions from a rebound apparatus located on the playing surface between the players such that the court is divided into first and second opposed playing areas with the rebound apparatus placed therebetween, the rebound apparatus comprising:

first rebound means for placement laterally across the court to extend upwardly therefrom at an angle to the playing surface, the first rebound means including a first rebound face for confronting the first playing area and making an angle therewith such that upon reception of the ball from the first playing area the first rebound means will rebound the ball toward the first playing area;

second rebound means for placement laterally across the court to extend upwardly therefrom at an angle to the playing surface, the second rebound means including a second rebound face for confronting the second playing area and making an angle therewith such that upon reception of the ball from the second playing area the second rebound means will rebound the ball toward the second playing area; and return area means between and extending upwardly above the first and second rebound means for defining an open, generally vertical return area of prescribed dimensions through which the ball is to be passed upon return of the ball from one of the first and second playing areas to the other of the first and second playing areas.

2. The invention of claim 1 wherein the angle between each of the first and second rebound faces and the corresponding one of the first and second playing areas is an obtuse angle.

3. The invention of claim 2 wherein the rebound apparatus includes a frame having:

foot portions located in a basal plane for placement upon the playing surface;

a first frame section extending upwardly from the basal plane at a first acute angle thereto for carrying the first rebound means;

a second frame section extending upwardly from the basal plane at a second acute angle thereto for carrying the second rebound means;

the first and second frame sections intersecting at an apex to establish a generally triangular profile with the basal plane defining the base of the triangular profile and the frame sections defining the sides of the triangular profile; and a third frame section extending generally vertically upwardly from the apex and establishing a fixed perimeter around the return area.

4. The invention of claim 3 wherein each rebound means includes a rebound net and the rebound apparatus includes tensioning means tensioning the rebound net within a corresponding frame section.

5. The invention of claim 4 wherein the first and second acute angles are equal and the triangular profile is an isosceles triangle.

6. The invention of claim 5 wherein:

the foot portions are each located at a corner of a rectangle in the basal plane;

the first frame section includes first leg members, each extending upwardly from a foot portion to the apex, and a first cross-member extending laterally between the first leg members intermediate the foot portions and the apex;

the second frame section includes second leg members, each extending upwardly from a foot portion to the apex, and a second cross-member extending laterally between the second leg members intermediate the foot portions and the apex; and the frame includes a third cross-member having opposite ends and extending laterally along the apex.

7. The invention of claim 6 wherein the rebound net includes opposite ends, and each opposite end is secured to one of the first and second cross-members, with the rebound net passing over the third cross-member.

8. The invention of claim 6 wherein the third frame section includes a pair of upright members, one upright member extending vertically from the apex adjacent each end of the third cross-member, and a fourth cross-member extending laterally between the upright members generally parallel to the third cross-member and spaced vertically upwardly from the third cross-member to define a generally rectangular return area bounded by the third and fourth cross-members and the upright members.

9. The invention of claim 8 wherein each opposed playing area is trapezoidal and includes a base line opposite side lines extending from the rebound apparatus location to the base line, the base line being the longer of the bases of the trapezoidal configuration.

10. The invention of claim 9 including a service line extending across the court adjacent the rebound apparatus location and parallel to the base line in each playing area.

11. The invention of claim 1 wherein each opposed playing area is trapezoidal and includes a base line and opposite side lines extending from the rebound apparatus location to the base line, the base line being the longer of the bases of the trapezoidal configuration.

12. The invention of claim 11 including a service line extending across the court adjacent the rebound apparatus location and parallel to the base line in each playing area.

13. A rebound ball game apparatus comprising:

a frame;

foot portions on the frame and located in a basal plane;

a first rebound face on the frame extending upwardly from the basal plane at a first acute angle thereto;

a second rebound face on the frame extending upwardly from the basal plane at a second acute angle thereto, the second acute angle being spaced from the first acute angle such that the first and second rebound faces intersect at an apex located between the first and second rebound faces and above the basal plane; and frame members on the frame extending upwardly above the first and second rebound faces and defining an open return area above the apex.

14. The invention of claim 13 including at least one rebound member on the frame, the rebound member including a portion located at least at one of the first and second rebound faces.

15. The invention of claim 14 wherein the rebound member is a net and the apparatus includes tensioning means tensioning the net on the frame.

16. The invention of claim 15 wherein the first and second acute angles are equal.

17. The invention of claim 13 wherein the frame members include upright frame members extending vertically upwardly from the apex and a cross-member extending between the upright frame members and spaced around from the apex to establish a fixed perimeter around the open return area.

18. The invention of claim 16 wherein the frame members include upright frame members extending vertically upwardly from the apex and a cross-member extending between the upright frame members and spaced upwardly from the apex to establish a fixed perimeter around the open return area.

* * * * *